US005842371A

United States Patent [19]

Liaw

[11] Patent Number: 5,842,371

[45] Date of Patent: Dec. 1, 1998

[54] WIRE CRIMPER HAVING ADJUSTMENT MECHANISM FOR ADJUSTING PITCH OF THE JAW MOUTH

[76] Inventor: Gwo-Jiang Liaw, No. 44, Chung Cheng Rd., Hsinchuang, Taipei Hsien, Taiwan

[21] Appl. No.: 22,418

[22] Filed: Feb. 12, 1998

[51] Int. Cl.[6] ..... H01R 43/042

[52] U.S. Cl. ..... 72/409.12; 29/751; 81/313; 81/382; 81/406

[58] Field of Search ..... 72/409.01, 409.12, 72/409.07; 29/751; 81/313, 382, 383, 384, 406

[56] References Cited

U.S. PATENT DOCUMENTS

| | | | |
|---|---|---|---|
| 3,157,075 | 11/1964 | Filia | 81/313 |
| 3,204,445 | 9/1965 | Filia | 81/313 |
| 4,794,780 | 1/1989 | Battenfeld | 81/313 |
| 4,829,805 | 5/1989 | Koehn | 81/313 |
| 4,980,962 | 1/1991 | Wiebe | 29/751 |
| 5,012,666 | 5/1991 | Chen | 72/409.01 |
| 5,042,286 | 8/1991 | Wiebe | 81/313 |

*Primary Examiner*—Daniel C. Crane
*Attorney, Agent, or Firm*—Rosenberg, Klein & Bilker

[57] ABSTRACT

A wire crimper having a body with a fixed jaw, a lever, a movable jaw pivoted between the body and the lever, a ratchet member coupled between a body and a lever thereof, a release plate pivoted to the lever and forced by a spring into engagement with the ratchet, and an adjustment mechanism for adjusting the angular position of a ratchet member relative to the body, the adjustment mechanism including an eccentric shaft to which the ratchet member is pivoted, a fixed stub locating rod at the body, an adjustment wheel axially movably supported on the eccentric shaft and adapted for turning the eccentric shaft to change the angular position of the ratchet member, and a spring washer retained to the eccentric shaft and forcing adjustment wheel into engagement with the fixed stub locating rod to stop the adjustment wheel from rotary motion.

4 Claims, 7 Drawing Sheets

WIRE CRIMPER HAVING ADJUSTMENT MECHANISM FOR ADJUSTING PITCH OF THE JAW MOUTH

BACKGROUND OF THE INVENTION

The present invention relates to a wire crimper, and more specifically to an adjustment mechanism for a wire crimper for adjusting the pitch of the mouth between the fixed jaw and the movable jaw.

FIG. 1 shows a wire crimper according to the prior art. This structure of wire crimper comprises a body 1, a fixed jaw 6 at the front side of the body 1, a movable jaw 2 pivoted to the body 1 adjacent to the fixed jaw 6, a lever 3 pivoted to the movable jaw 2, a ratchet member 4 coupled between the body 1 and the lever 3 and oscillated with the movement of the lever 3 to control the opening angle of the movable jaw 2 relative to the fixed jaw 6, and a release plate 5 pivoted to the lever 3 and forced by a spring (not shown) into engagement with the ratchet member 4. The ratchet member 4 has a release notch 7. When the lever 3 is squeezed further after the movable jaw 2 and the fixed jaw 6 are closed, the release plate 5 is shifted from the teeth on the ratchet member 4 to the release notch 7, the movable jaw 2 can then be turned to the full-open position. The wire crimper further comprises an adjustment wheel 10 fastened to an eccentric shaft 8 by a lock ring 9, and provided for adjusting the closeness between the movable jaw 2 and the fixed jaw 6. During adjustment, the lock screw of the lock ring 9 must be removed so that the adjustment wheel 10 and the eccentric shaft 8 can be rotated with the hand. After adjustment, the lock screw must be installed again to fix the lock ring 9. This adjustment procedure is complicated. Another drawback of this structure of wire crimper is that the spring which pulls the ratchet member in one direction may escape out of the body through the top open side of the body when the spring is disconnected from the ratchet member due to an operation error. Further, because the release plate 5 partially projects out of the top side of the lever 3, the release plate 5 must be operated with the other hand when the wire crimper is held in one hand.

SUMMARY OF THE INVENTION

The present invention has been accomplished to provide a wire crimper which eliminates the aforesaid drawbacks. According to one aspect of the present invention, the wire crimper comprises a body with a fixed jaw, a lever, a movable jaw pivoted between the body and the lever, a ratchet member coupled between a body and a lever thereof, a spring member coupled between the body and the ratchet member and imparting a forward pulling force to the ratchet member, a release plate pivoted to the lever and forced by a spring into engagement with the ratchet, and an adjustment mechanism for adjusting the angular position of a ratchet member relative to the body, the adjustment mechanism comprising an eccentric shaft to which the ratchet member is pivoted, a fixed stub locating rod at the body, an adjustment wheel axially movably supported on the eccentric shaft and adapted for turning the eccentric shaft to change the angular position of the ratchet member, and a spring washer retained to the eccentric shaft and forcing adjustment wheel into engagement with the fixed stub locating rod to stop the adjustment wheel from rotary motion. According to another aspect of the present invention, the body has a top open side covered with a top cover plate to prohibit the spring member from escaping out of the body when the spring member is disconnected from the ratchet member due to an operation error. According to still another aspect of the present invention, the release plate has a bottom end projecting out of the bottom side of the lever for operation by the forefinger.

DETAILED DESCRIPTION OF THE PREFERRED EMBODIMENT

Figure 1:
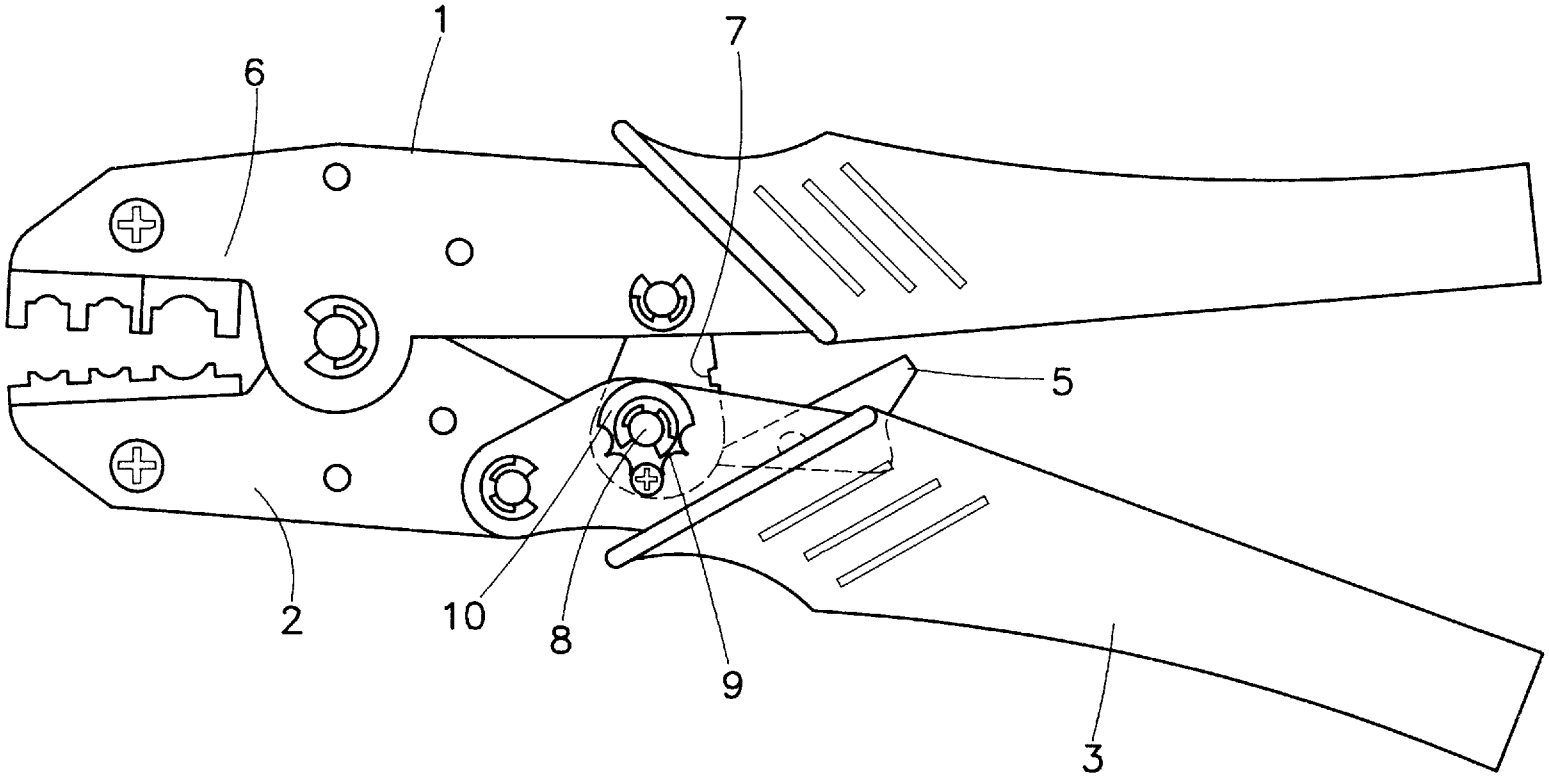
FIG. 1 is a plain view of a wire crimper according to the prior art.
Figure 2:
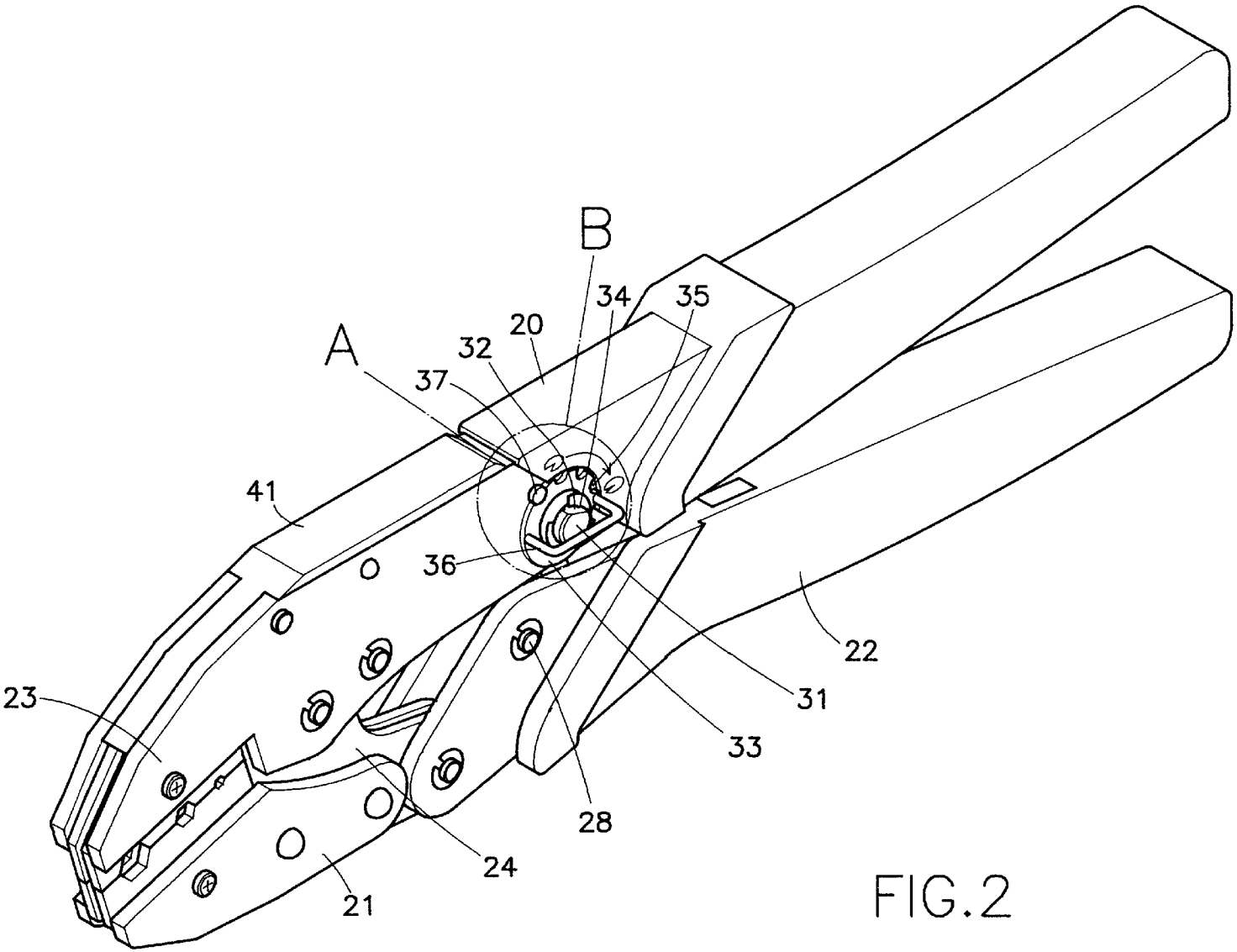
FIG. 2 is a perspective view of a wire crimper according to the present invention.
Figure 2A:
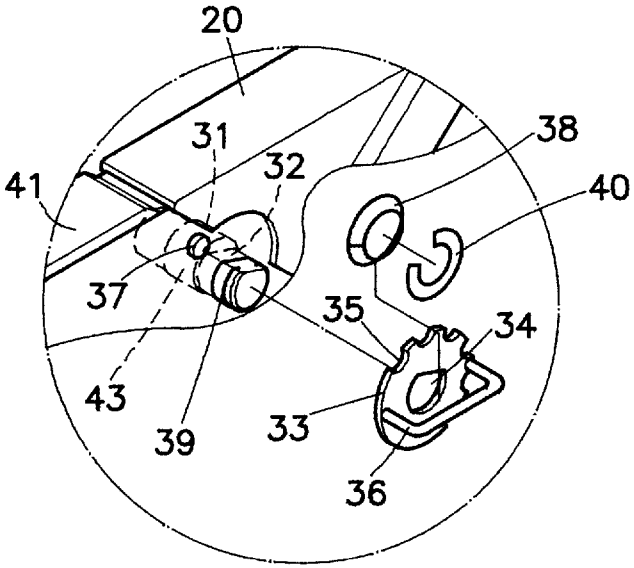
FIG. 2A is an exploded view in an enlarged view of a part of FIG. 2, showing relationship between the adjustment wheel, the spring washer and the shaft.
Figure 2B:
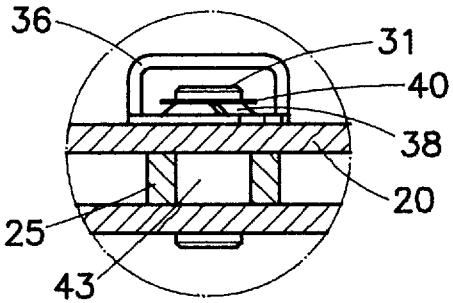
FIG. 2B is a sectional assembly view of FIG. 2A.
Figure 3:
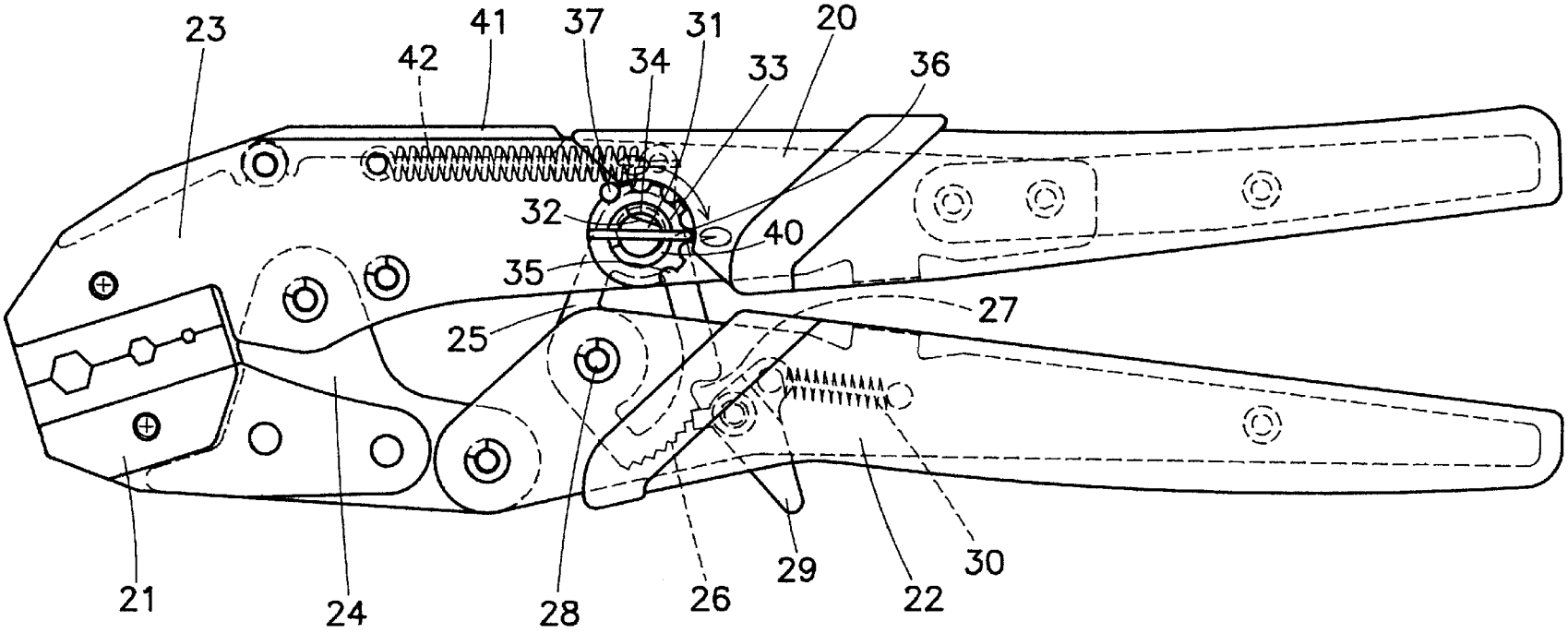
FIG. 3 is a plain view of the wire crimper shown in FIG. 2.

Referring to FIGS. 2 and 3, a wire crimper comprises a body 20, a movable jaw 21 pivoted to the body 20, a lever 22 for moving the movable jaw 21. A fixed jaw 23 is provided at the front end of the body 20. A coupling plate 24 is fixedly fastened to the movable jaw 21, having one end pivoted to the body 20 adjacent to the fixed jaw 23 and an opposite end pivoted to the front end of the lever 22. A top cover plate 41 is covered on the body 20 at its top side.

A ratchet member 25 is coupled between the body 20 and the lever 22. The ratchet member 25 is oscillated when the lever 22 is moved relative to the body 20. A spring 42 is mounted inside the body 20, having one end fixedly connected to the body 20 and an opposite end connected to the ratchet member 25. The spring 42 imparts a pulling force to the ratchet member 25. The ratchet member 25 is pivoted to a shaft 31 on the body 20 and a pivot 28 on the lever 22, having a series of teeth 26 and a release notch 27 at one end of the series of teeth 26. The release notch 27 is deeper then the pitch between the teeth 26.

A release plate 29 is pivoted to the lever 22 and partially projecting out of the bottom side of the lever 22. A spring 30 is provided at the lever 22, having one end fixedly connected to the lever 22 and an opposite end connected to one end of the release plate 29. The release plate 29 is pulled by the spring 30 into engagement with the teeth 26 on the ratchet member 25 to hold the lever 22 in position. By pulling the release plate 29 against the spring force of the spring 30, the release plate 29 is disengaged from the teeth 26 on the ratchet member 25 to unlock the lever 22. When the movable jaw 21 and the fixed jaw 23 are closed, the user can force the lever 22 toward the body 20 to shift the release plate 29 from the teeth 26 to the release notch 27, enabling the lever 21 to be moved to the full-open position.

The shaft 31 is turned in a hole on the body 20, having an extension rod 32 of D-shaped cross section at one end. The extension rod 32 has locating groove 39 around the periphery. An adjustment wheel 33 is mounted around the extension rod 32. Retainer 40 is fastened to the locating groove 39 on the extension rod 32 to secure the adjustment wheel 33 in place. The adjustment wheel 33 has a D-shaped center hole 34 into which the extension rod 32 fits, a handle 36 at an outer side, and a plurality of locating notches 35 at the periphery. A spring washer 38 is mounted around the extension rod 32 between the adjustment wheel 33 and the retainer 40. A stub locating rod 37 is provided at the body 20 adjacent to the shaft 31 for engagement with one locating notch 35 on the adjustment wheel 33. Further, the shaft 31 has an eccentric portion 43 inserted into an opening on the ratchet member 25 and disposed in contact with the inside wall of the ratchet member 25. By means of rotating the shaft 25 to change the contact between the inside wall of the ratchet member 25 and the eccentric portion 43 of the shaft 25, the angular position of the ratchet member 25 is relatively changed.

Figure 4:
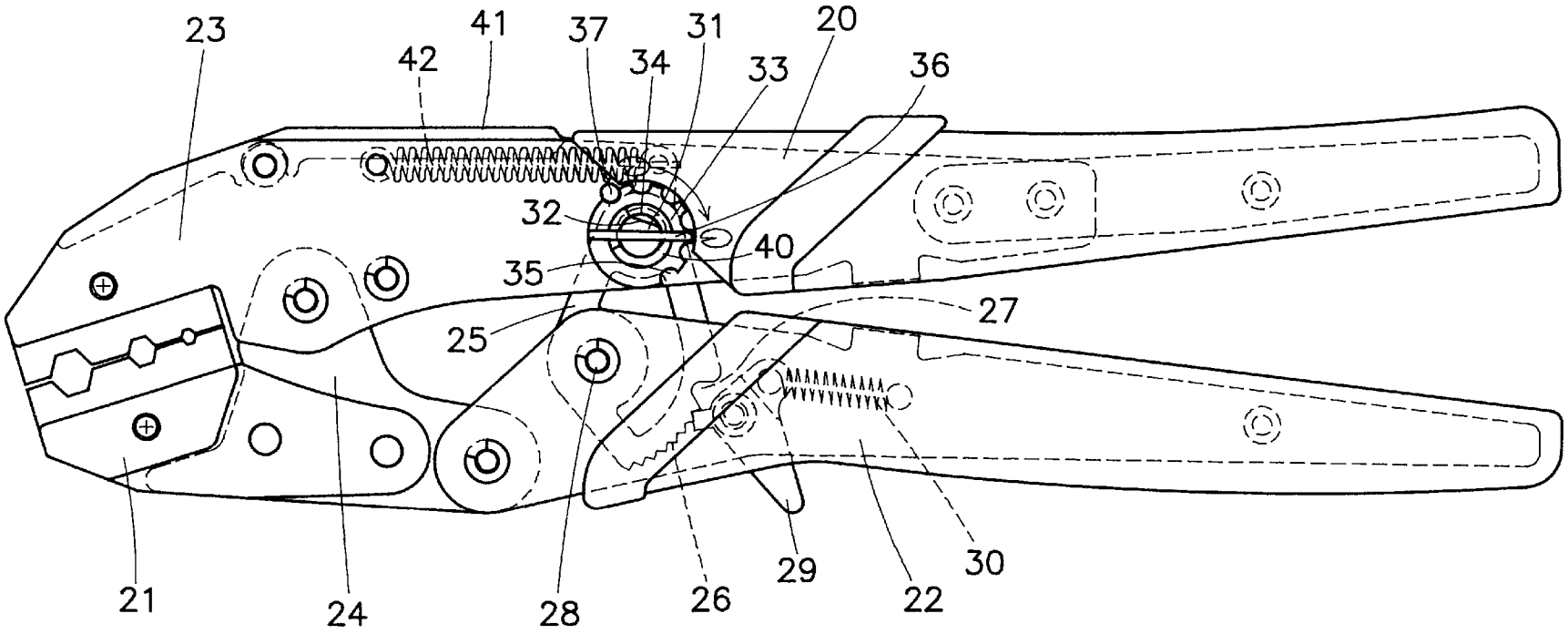
FIG. 4 is similar to FIG. 3 but showing the angular position of the ratchet member adjusted.
Figure 5:
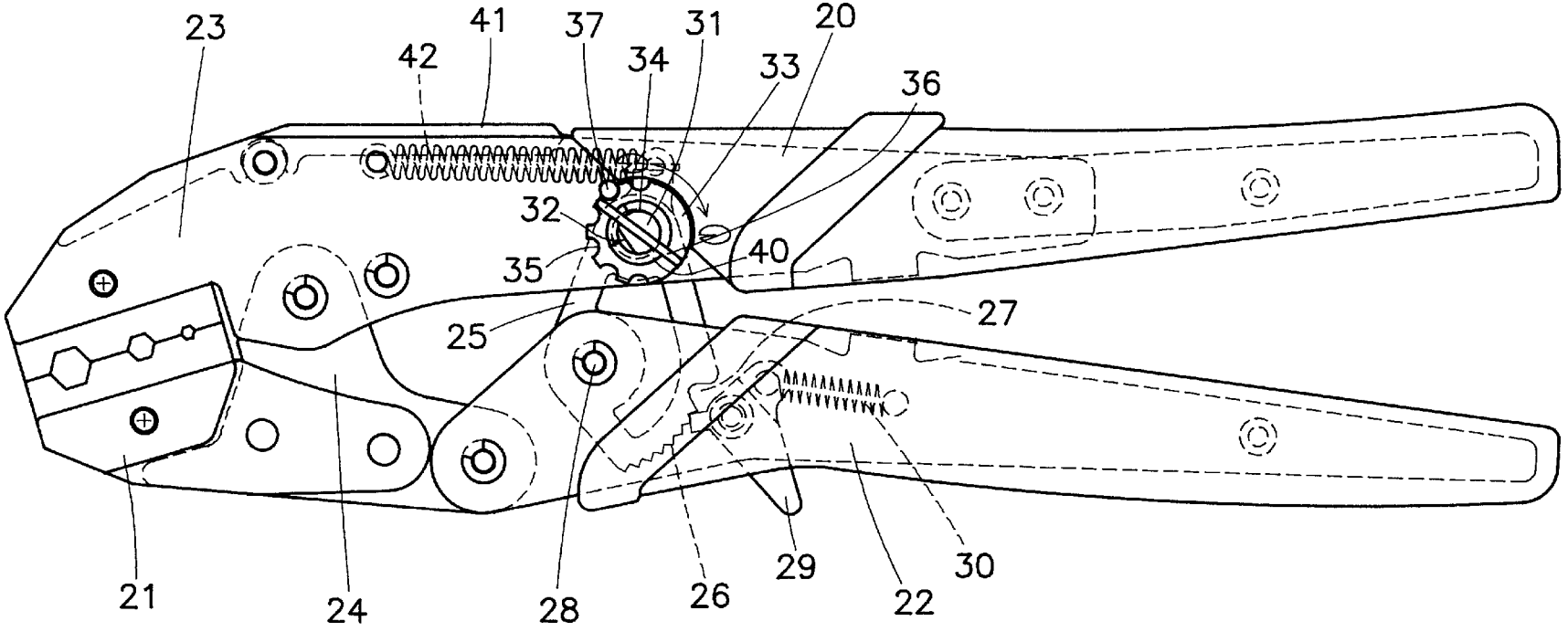
FIG. 5 is similar to FIG. 4 but showing the release plate disengaged from the ratchet member.

Referring to FIG. 4 and FIGS. 2 and 3 again, when the handle 36 is pulled outwards and rotated, the shaft 31 is rotated, and the eccentric portion 43 of the shaft 31 is forced against the inside wall of the ratchet member 25, causing the angular position of the ratchet member 25 to be changed, and therefore the closeness between the movable jaw 21 and the fixed jaw 23 is relatively adjusted. After adjustment, the adjustment wheel 33 is forced backwards into engagement with the stub locating rod 37 by the spring washer 38.

As indicated above, the angular position of the ratchet member 25 can be conveniently adjusted by pulling the handle 36 outwards and then turning the handle 36 to change angle of the eccentric portion 43 of the shaft 31. During adjusting the angular position of the ratchet member 25, it is not necessary to dismount any part of the wire crimper. When the handle 36 is released from the hand after an adjustment is done, the adjustment wheel 33 is automatically pushed back into engagement with the stub locating rod 37 by the spring washer 38. Another advantage of the wire crimper of the invention is that the spring 42 is prohibited from escaping out of the body 20 because the top side of the body 20 is covered by the top cover plate 41. Further, because the release plate 29 partially projects out of the bottom side of the lever 22, it can be conveniently operated with the forefinger when the wire crimper is held in the hand.

While only one embodiment of the present invention has been shown and described, it will be understood that various modifications and changes could be made thereunto without departing from the spirit and scope of the invention disclosed.

What the invention claimed is:

1. A wire crimper comprising a hollow body, a fixed jaw at a front side of said body, a movable jaw pivoted to said body adjacent to said fixed jaw, a lever pivoted to said movable jaw, a ratchet member coupled between said body and said lever and oscillated with the movement of said lever to control the opening angle of said movable jaw relative to said fixed jaw, a release plate pivoted to said lever and forced by spring means into engagement with said ratchet member, and an adjustment mechanism controlled to adjust the angular position of said ratchet member relative to said body, wherein said adjustment mechanism comprises a shaft turned in a hole on said body, said shaft having a non-circular extension rod axially disposed at one end and an eccentric portion on the middle disposed in contact with said ratchet member, a fixed stub locating rod provided at said body, a retainer fastened to said non-circular extension rod, an adjustment wheel mounted on said non-circular extension rod and moved axially along said non-circular extension rod, said adjustment wheel having a non-circular center hole which receives said non-circular extension rod, a plurality of locating notches at the periphery, and a handle at an outer side thereof, and a spring washer mounted around said non-circular extension rod between said adjustment wheel and said retainer, said spring washer imparting an inward force to said adjustment wheel, causing one locating notch of said adjustment wheel to be retained in engagement with said stub locating rod, said shaft being rotated with said adjustment wheel when said handle is pulled outwards to disengage said adjustment wheel from said stub locating rod and then rotated by hand, the eccentric portion of said shaft being rotated with said shaft against said ratchet member when said non-circular extension rod is rotated upon rotation of said adjustment wheel, causing the angular position of said ratchet member to be changed.

2. The wire crimper of claim 1, wherein said body has an open top side covered with a top cover plate.

3. The wire crimper of claim 1, wherein said release plate is partially projecting out of a bottom side of said lever remote from said body.

4. The wire crimper of claim 1, wherein a spring member is provided at said body to impart a forward pulling force to one end of said ratchet member.

* * * * *